US007398627B2

(12) United States Patent
Yamamoto

(10) Patent No.: US 7,398,627 B2
(45) Date of Patent: Jul. 15, 2008

(54) LATTICE PANEL AND A LATTICE PANEL CONSTRUCTING METHOD

(75) Inventor: Riken Yamamoto, Yokohama (JP)

(73) Assignees: Riken-Yamamoto & Field Shop Co., Ltd., Yokohama-shi (JP); Sus Co., Ltd., Shizuoka-shi (JP)

( * ) Notice: Subject to any disclaimer, the term of this patent is extended or adjusted under 35 U.S.C. 154(b) by 396 days.

(21) Appl. No.: 10/936,488

(22) Filed: Sep. 9, 2004

(65) Prior Publication Data

US 2005/0050826 A1 Mar. 10, 2005

(30) Foreign Application Priority Data

Sep. 9, 2003 (JP) ..... 2003-317043

(51) Int. Cl.
*E04C 2/42* (2006.01)
*E06B 3/964* (2006.01)

(52) U.S. Cl. ..... 52/660; 52/663; 52/204.61

(58) Field of Classification Search ..... 52/663, 52/664, 660, 676, 659, 656.8, 656.7, 204.61; 428/119; 256/19, 21, 24; 49/57, 50
See application file for complete search history.

(56) References Cited

U.S. PATENT DOCUMENTS 1,641,523 A * 9/1927 Bell ..... 160/381
2,594,864 A * 4/1952 Buckland et al. ..... 160/351
3,086,629 A * 4/1963 Blitzer ..... 52/799.1
3,103,264 A * 9/1963 Katan ..... 52/663
3,155,202 A * 11/1964 Milette ..... 52/663
3,302,412 A * 2/1967 Hunsucker ..... 405/278
3,785,098 A * 1/1974 Schweitzer et al. ..... 52/663
4,794,744 A * 1/1989 Young et al. ..... 256/24
5,241,799 A * 9/1993 Jahn ..... 52/506.06

FOREIGN PATENT DOCUMENTS

JP 405141158 A * 10/1991 ..... 49/50
JP 07324524 A * 12/1995
JP 9-302809 11/1997
JP 11-247337 9/1999
JP 11-256726 9/1999
JP 2001-317156 11/2001
JP 2003-105918 4/2003

* cited by examiner

*Primary Examiner*—Brian Glessner
*Assistant Examiner*—Adriana Figueroa
(74) *Attorney, Agent, or Firm*—McGinn IP Law Group, PLLC

(57) ABSTRACT

A lattice panel (1) having a simple structure and capable for easy construction of strong and comfortable building, comprising several cross-shaped first skeleton members (7) and the L-shaped second skeleton members (9), to be connected to each other, wherein a panel bodies (3) are formed by connecting the second skeleton members (9) to the outer periphery of the first skeleton members (7), and frame members (11) are attached to the outer periphery of the panel bodies (3, 5).

9 Claims, 14 Drawing Sheets

LATTICE PANEL AND A LATTICE PANEL CONSTRUCTING METHOD

BACKGROUND OF THE INVENTION

1. Field of the Invention

The present invention relates to a lattice panel and a lattice panel constructing method. More particularly, the present invention relates to the lattice panel, in which, cross-shaped first skeleton members, L-shaped second skeleton members and frame members are appropriately combined as necessary, so that a wall structure having a desired strength may be obtained easily.

2. Description of the Related Art

There are several disclosures regarding so-called "panel construction", for example, patent documents 1, 2, 3, 4 and 5, as follows:

Patent Document 1: Official Gazette of Japanese Unexamined Patent Publication No. Hei 9-302809;

Patent Document 2: Official Gazette of Japanese Unexamined Patent Publication No. Hei 11-247337;

Patent Document 3: Official Gazette of Japanese Unexamined Patent Publication No. Hei 11-256726;

Patent Document 4: Official Gazette of Japanese Unexamined Patent Publication No. 2001-317156; and Patent Document 5: Official Gazette of Japanese Unexamined Patent Publication No. 2003-105918.

However, the conventional structure according to the above disclosures has several disadvantageous points.

First, the conventional "panel construction" methods have been solely focused on wooden houses, and therefore, there is no structure suitable for various factories, workshops, offices, etc.

Second, although there are several "panel construction" methods for factories, workshops or offices, they are all very simple structure, i.e. "prefabricated construction", having poor strength and habitability.

SUMMARY OF THE INVENTION

It is an object of the present invention to provide a lattice panel, which enables the construction of building having excellent strength and habitability, with simple structure and by easy working.

To achieve the object mentioned above, according to claim 1 of the present invention, there is provided a lattice panel, comprising: a panel body, assembled by continuously connecting several numbers of cross-shaped first skeleton members, and by continuously connecting L-shaped second skeleton members to the outer periphery of the first skeleton members; and frame members attached to the outer periphery of the panel body.

According to claim 2 of the present invention, there is provided the lattice panel as claimed in claim 1, further characterized in that: the first skeleton member has engagement parts at the end of four elongating parts, so that the first skeleton members adjacent to each other may be connected by engaging the engagement parts with each other.

According to claim 3 of the present invention, there is provided the lattice panel as claimed in claim 1, further characterized in that: the second skeleton member also has engagement parts at the end of two elongating parts, respectively in the same shape as that of the engagement part of the first skeleton member, so that the second skeleton member may be connected to the adjacent first skeleton member, by engaging the engagement part of the second skeleton member with the engagement part of the first skeleton member.

According to claim 4 of the present invention, there is provided the lattice panel as claimed in claim 2, further characterized in that: the engagement part is comprising, a first recessed part, a half-round shape of a second recessed part continuously formed by following the first recessed part, a first salient part provided at the outer side of the second recessed part, and a second salient part protruding at the end of the engagement part.

According to claim 5 of the present invention, there is provided the lattice panel as claimed in claim 3, further characterized in that: the engagement part is comprising, a first recessed part, a half-round shape of a second recessed part continuously formed by following the first recessed part, a first salient part provided at the outer side of the second recessed part, and a second salient part protruding at the end of the engagement part.

According to claim 6 of the present invention, there is provided the lattice panel as claimed in claim 4, further characterized in that: the first recessed part is engaged with the second salient part of another first skeleton member to be connected to each other, respectively having hooks at the first recessed part and the second salient part in order to prevent detachment thereof in the elongating direction.

According to claim 7 of the present invention, there is provided the lattice panel as claimed in claim 5, further characterized in that: the first recessed part is engaged with the second salient part of another first skeleton member to be connected to each other, respectively having hooks at the first recessed part and the second salient part in order to prevent detachment thereof in the elongating direction.

According to claim 8 of the present invention, there is provided the lattice panel as claimed in claim 4, further characterized in that: a hollow circle is formed by the second recessed parts when the engagement parts are connected to each other, and the engagement parts are fixed by inserting and adhering an axial member into the hollow circle.

According to claim 9 of the present invention, there is provided the lattice panel as claimed in claim 5, further characterized in that: a hollow circle is formed by the second recessed parts when the engagement parts are connected to each other, and the engagement parts are fixed by inserting and adhering an axial member into the hollow circle.

According to claim 10 of the present invention, there is provided the lattice panel as claimed in claim 4, further characterized in that: a hollow circle is formed by the second recessed parts when the engagement parts are connected to each other, and the engagement parts are bound and fixed by engagement with a screw member inserted into the hollow circle.

According to claim 11 of the present invention, there is provided the lattice panel as claimed in claim 5, further characterized in that: a hollow circle is formed by the second recessed parts when the engagement parts are connected to each other, and the engagement parts are bound and fixed by engagement with a screw member inserted into the hollow circle.

According to claim 12 of the present invention, there is provided the lattice panel as claimed in claim 1, further characterized in that: a flat part is formed at an L-shape corner of the second skeleton member, and the second skeleton member is fixed on the frame member via the flat part.

According to claim 13 of the present invention, there is provided a lattice panel, comprising: first panels according to any one claim of claims 1 through 12; and second panels formed only by the frame members, characterized in that: several numbers of the first panels and the second panels are connected to each other.

According to claim 14 of the present invention, there is provided a lattice panel constructing method, comprising steps of: continuously connecting several numbers of cross-shaped first skeleton members, by engaging engagement parts with each other and by fixing through fixing means; continuously connecting L-shaped second skeleton members to the outer periphery of the first skeleton members, by engaging engagement parts with each other and by fixing through fixing means, thus assembling a panel body; constructing first panels by attaching frame members to the outer periphery of the panel body; and continuously connecting several numbers of the first panels.

According to claim 15 of the present invention, there is provided the lattice panel constructing method as claimed in claim 14, further comprising steps of: preparing second panels formed only by the frame members and continuously connecting appropriate numbers of the second panels to the first panels.

The lattice panel according to the present invention has the following merits.

First, according to claim 1 of the present invention, the lattice panel has the panel body, assembled by continuously connecting several numbers of cross-shaped first skeleton members, and by continuously connecting L-shaped second skeleton members to the outer periphery of the first skeleton members, and the frame members attached to the outer periphery of the panel body. Thus, it is possible to provide a wall structure having a relatively simple structure and a sufficient strength.

According to claim 2 of the present invention, the first skeleton member has the engagement parts at the end of four elongating parts, so that the first skeleton members adjacent to each other may be connected by engaging the engagement parts with each other. Thus, it is possible to connect the first skeleton members to each other easily, and to obtain the reliable connecting structure.

According to claim 3 of the present invention, the second skeleton member also has the engagement parts at the end of two elongating parts, respectively in the same shape as that of the engagement part of the first skeleton member, so that the second skeleton member may be connected to the adjacent first skeleton member, by engaging the engagement part of the second skeleton member with the engagement part of the first skeleton member. Thus, it is possible to connect the first skeleton member to the second skeleton member easily, and to obtain the reliable connecting structure.

According to claim 4 of the present invention, with regard to the lattice panel of claim 2, the engagement part is comprising, the first recessed part, the half-round shape of the second recessed part continuously formed by following the first recessed part, the first salient part provided at the outer side of the second recessed part, and the second salient part protruding at the end of the engagement part. Thus, when the first skeleton members are connected to each other, the respective first recessed parts are engaged with the respective second salient parts, and the both second recessed parts form a hollow circle, whereby the strong connecting structure may be obtained.

According to claim 5 of the present invention, with regard to the lattice panel of claim 3, the engagement part is comprising, the first recessed part, the half-round shape of the second recessed part continuously formed by following the first recessed part, the first salient part provided at the outer side of the second recessed part, and the second salient part protruding at the end of the engagement part. Thus, when the first skeleton member is connected to the second skeleton member, the respective first recessed parts are engaged with the respective second salient parts, and the both second recessed parts form a hollow circle, whereby the strong connecting structure may be obtained.

According to claim 6 of the present invention, with regard to the lattice panel of claim 4, the first recessed part is engaged with the second salient part of another first skeleton member to be connected to each other, respectively having the hooks at the first recessed part and the second salient part in order to prevent detachment thereof in the elongating direction. Thus, the detachment of the first recessed part from the second salient part may be prevented effectively.

According to claim 7 of the present invention, it is also possible to prevent the detachment in the elongating direction effectively.

According to claim 8 of the present invention, with regard to the lattice panel of claim 4, the hollow circle is formed by the second recessed parts when the engagement parts are connected to each other, and the engagement parts are fixed by inserting and adhering the axial member into the hollow circle. Thus, it is possible to obtain further strong connecting structure.

According to claim 9 of the present invention, with regard to the lattice panel of claim 5, the hollow circle is formed by the second recessed parts when the engagement parts are connected to each other, and the engagement parts are fixed by inserting and adhering the axial member into the hollow circle. Thus, it is also possible to obtain further strong connecting structure.

According to claim 10 of the present invention, with regard to the lattice panel of claim 4, the hollow circle is formed by the second recessed parts when the engagement parts are connected to each other, and the engagement parts are bound and fixed by engagement with the screw member inserted into the hollow circle. Thus, it is possible to obtain further strong connecting structure.

According to claim 11 of the present invention, with regard to the lattice panel of claim 5, the hollow circle is formed by the second recessed parts when the engagement parts are connected to each other, and the engagement parts are bound and fixed by engagement with the screw member inserted into the hollow circle. Thus, it is also possible to obtain further strong connecting structure.

According to claim 12 of the present invention, with regard to the lattice panel of claim 1, the flat part is formed at the L-shape corner of the second skeleton member, and the second skeleton member is fixed on the frame member via the flat part. Thus, it is possible to obtain the stable fixing state on the frame members.

According to claim 13 of the present invention, the lattice panel is comprising, the first panels according to any one claim of claims 1 through 12, and the second panels formed only by the frame members, and the several numbers of the first panels and the second panels are connected to each other. Thus, as compared with the case in which only the first panels are used for the lattice panel, it is possible to reduce the total weight, and to facilitate the assemble working.

According to claims 14 and claim 15 of the present invention, the lattice panel constructing method enables the constructing of strong lattice panel easily.

BRIEF DESCRIPTION OF THE DRAWINGS

The invention will be described below in detail with reference to the accompanying drawings, in which.

DETAILED DESCRIPTION OF THE INVENTION

First Embodiment

Figure 1B:
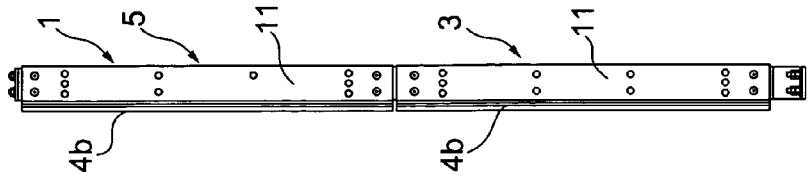
FIG. 1 has views showing a first embodiment of the present invention, in which, FIG. 1(*a*) is a front view of a lattice panel, and FIG. 1(*b*) is a side view of the lattice panel.
Figure 1A:
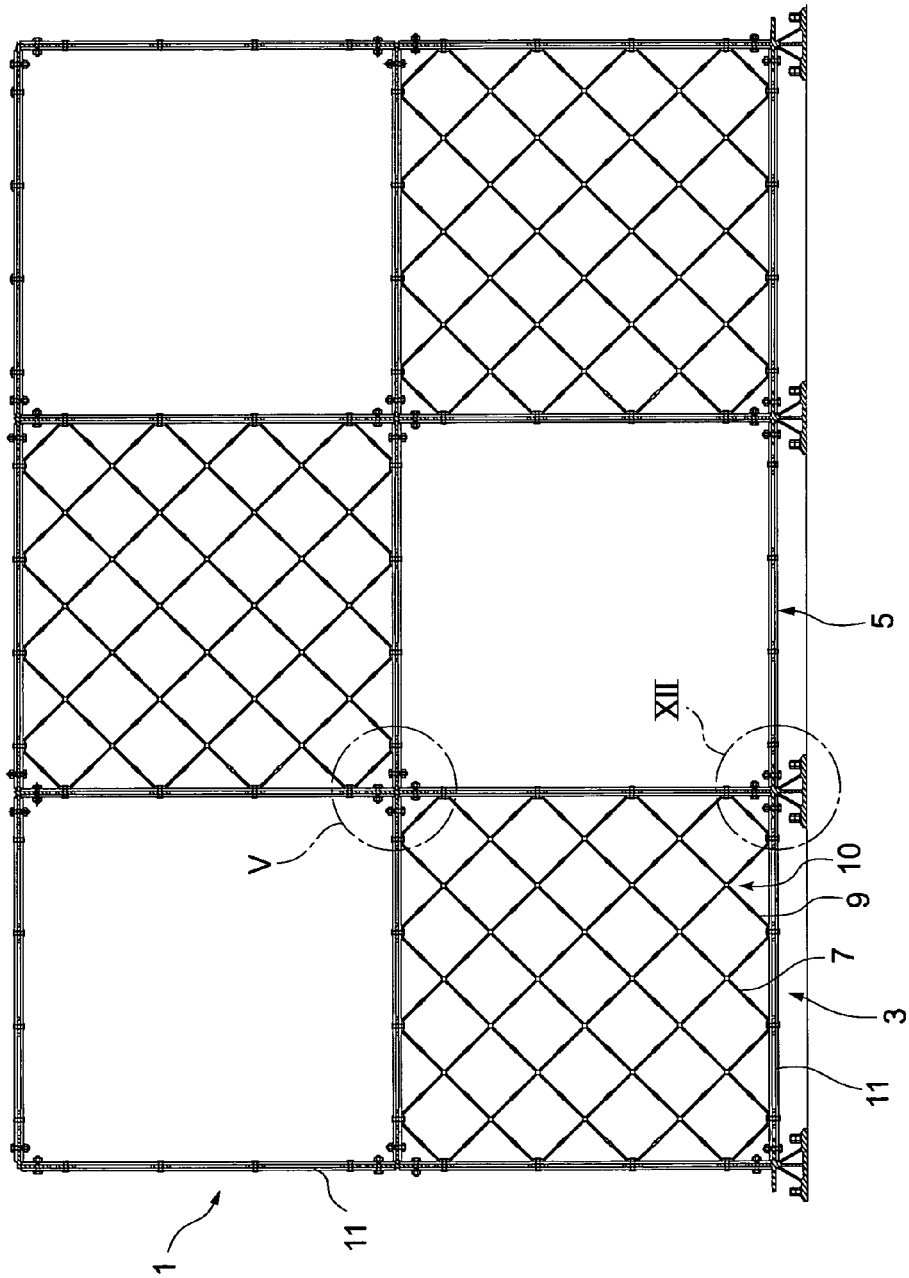

A first embodiment of the present invention will now be described with reference to FIGS. 1 through 12. FIG. 1(*a*) is a front view showing a partial structure of a lattice panel according to the first embodiment, and FIG. 1(*b*) is a side view of the lattice panel. Basically, a lattice panel 1 comprises first panels 3 and second panels 5 in a houndstooth check arrangement.

The first panel 3 has several numbers of cross-shaped first skeleton members 7 connected to each other, and also has several numbers of L-shaped second skeleton members 9 connected to these first skeleton members 7 along the outer periphery of the first skeleton members 7, thus serving as a panel body 10. There are frame members 11 surrounding the outer periphery of the panel body 10. On the other hand, the second panel 5 only comprises the frame members 11.

The inner part of the frame members 11 of the first panel 3 will accept, for example, a glass panel or an aluminum panel set therein, according to required situations. Similarly, the inner part of the frame members 11 of the second panel 5 will accept, for example, a glass panel or an aluminum panel set therein, according to required situations. Although the glass panel or aluminum panel is not illustrated in FIG. 1, the explanation will be done afterward, with reference to FIGS. 8 and 9.

Figure 2:
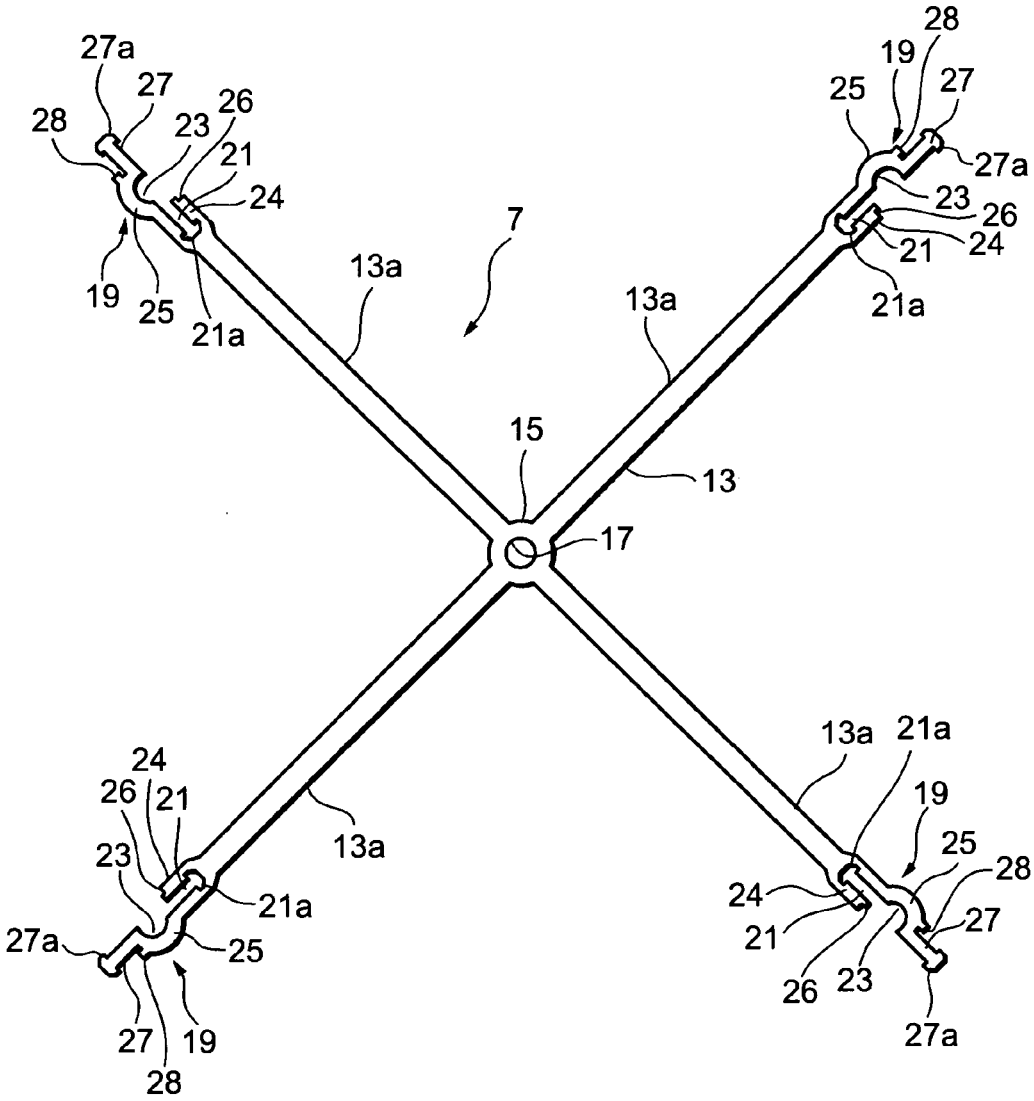
FIG. 2 is a plan view of a cross-shaped first skeleton member according to the first embodiment of the present invention.

FIG. 2 illustrates the structure of the first skeleton member 7. There is a cross-shaped skeleton member body 13, a center part 15 provided at the center of the skeleton member body 13, a penetrating hole 17 which is penetrating through the center part 15, and engagement parts 19 respectively provided at the end of four elongating parts 13*a* of the skeleton member body 13.

Each of the engagement parts 19 has a first recessed part 21 elongated and formed in the elongating direction of the engagement part 19, a second recessed part 23 substantially in a half-round shape continuously formed by following the first recessed part 21, a third recessed part 26 formed at the end of a protrusive chip 24 comprising the first recessed part 21, a first salient part 25 at the outer part of the second recessed part 23, a second salient part 27 protruding at the and of the engagement part 19, and a third salient part 28 provided at a position between the first salient part 25 and the second salient part 27. The shape of the first recessed part 21 is the same as that of the second salient part 27. Thus, the inside of the first recessed part 21 may be engaged, with the second salient part 27 of the engagement part 19 of the adjacent other first skeleton member 7. The first recessed part 21 has a hook 21*a*, and similarly, the second salient part 27 has a hook 27*a*.

For reference, each of the engagement parts 19, respectively provided at the end of the four elongating parts 13*a*, is in the same shape.

Figure 3:
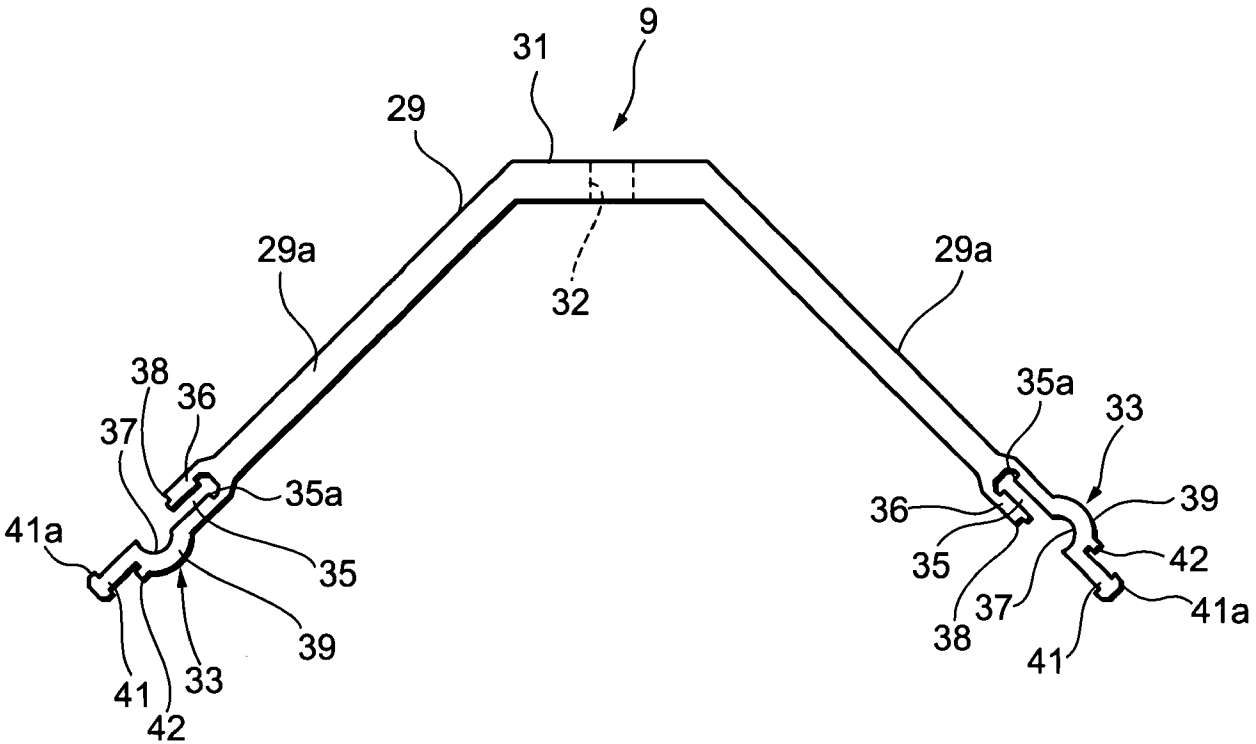
FIG. 3 is a plan vies of an L-shaped second skeleton member according to the first embodiment of the present invention.

Now the structure of the second skeleton member 9 will be explained with reference to FIG. 3. There is an L-shaped skeleton member body 29, and a flat part 31 is formed at the corner of the skeleton member body 29. A penetrating hole 32 is provided, penetrating through the flat part 31. Each end of two elongating parts 29*a* is provided with an engagement part 33.

The engagement part 33 has the same structure as that of the engagement part 19 of the first skeleton member 7 as discussed above. Accordingly, the engagement part 33 has a first recessed part 35 elongated and formed in the elongating direction of the engagement part 33, a second recessed part 37 substantially in a half-round shape continuously formed by following the first recessed part 35, a third recessed part 38 formed at the end of a protrusive chip 36 comprising the first recessed part 35, a first salient part 39 at the outer part of the second recessed part 37, a second salient part 41 protruding at the and of the engagement part 33, and a third salient part 42 provided at a position between the first salient part 39 and the second salient part 41. The shape of the first recessed part 35 is the same as that of the second salient part 41. Thus, the inside of the first recessed part 35 may be engaged, with the second salient part 27 of the engagement part 19 of the adjacent first skeleton member 7. The first recessed part 35 has a hook 35*a*, and similarly, the second salient part 41 has a hook 41*a*.

For reference, each of the engagement parts 19, respectively provided at the end of the two elongating parts 29*a*, is in the same shape.

Figure 4A:
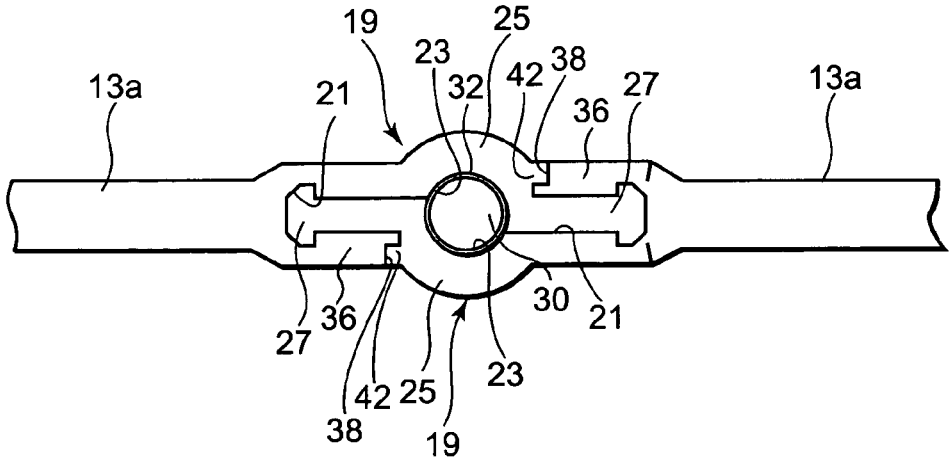
FIG. 4 has views showing the first embodiment of the present invention, in which, FIG. 4(*a*) is a view showing a connecting structure between the first skeleton member and the other first skeleton member, or between the first skeleton member and the second skeleton member, and FIG. 4(*b*) is a view showing another connecting structure between the first skeleton member and the other first skeleton member, or between the first skeleton member and the second skeleton member.
Figure 4B:
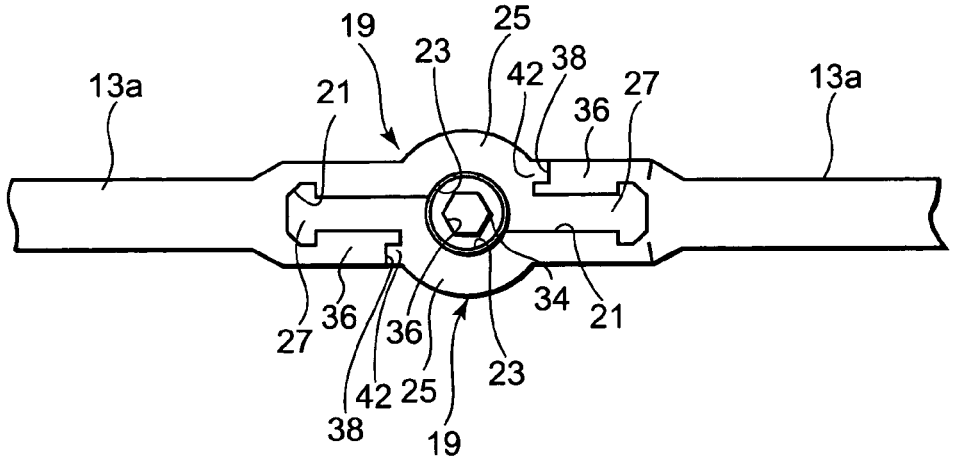

FIG. 4(*a*) shows a state in which the engagement parts 19, 19 of the first skeleton members 7, 7, adjacent to each other, are connected. The first recessed part 21 of the first skeleton member 7 on the one side is engaged with the second salient part 27 of the first skeleton member 7 on another side. Further, the third recessed part 26 of the first skeleton member 7 on the one side is engaged with the third salient part 28 of the first skeleton member 7 on the other side. Similarly, the first recessed part 21 of the first skeleton member 7 on the other side is engaged with the second salient part 27 of the first skeleton member 7 on the one side, and the third recessed part 26 of the first skeleton member 7 on the other side is engaged with the third salient part 28 of the first skeleton member 7 on the one side. The second recessed parts 23, 23 on the both sides form a hollow circle. There is an axial member 30 inserted and placed in the hollow circle, which is then adhered and fixed by an adhesive 32.

At that time, as illustrated in FIG. 4(*b*), it is possible to use a screw member 34 instead of the axial member 30, so that the screw member 34 may be engaged with the hollow circle formed by the second recessed parts 23, 23 of the both sides connected to each other. The screw member 34 has a hole 36 in which a hexagonal screwdriver (not shown) may be inserted. The screw member 34 has a self-tapping function, whereby an engagement thread may be made on the hollow circle formed by the second recessed parts 23, 23 on the both sides.

For reference, although FIG. 4 only shows the state in which the engagement parts 19, 19 of the first skeleton member 7, 7 adjacent to each other are connected to each other, the state in which the engagement parts 19, 33 of the first skeleton member 7 and the second skeleton member 9 are connected to each other, is substantially the same.

Figure 5:
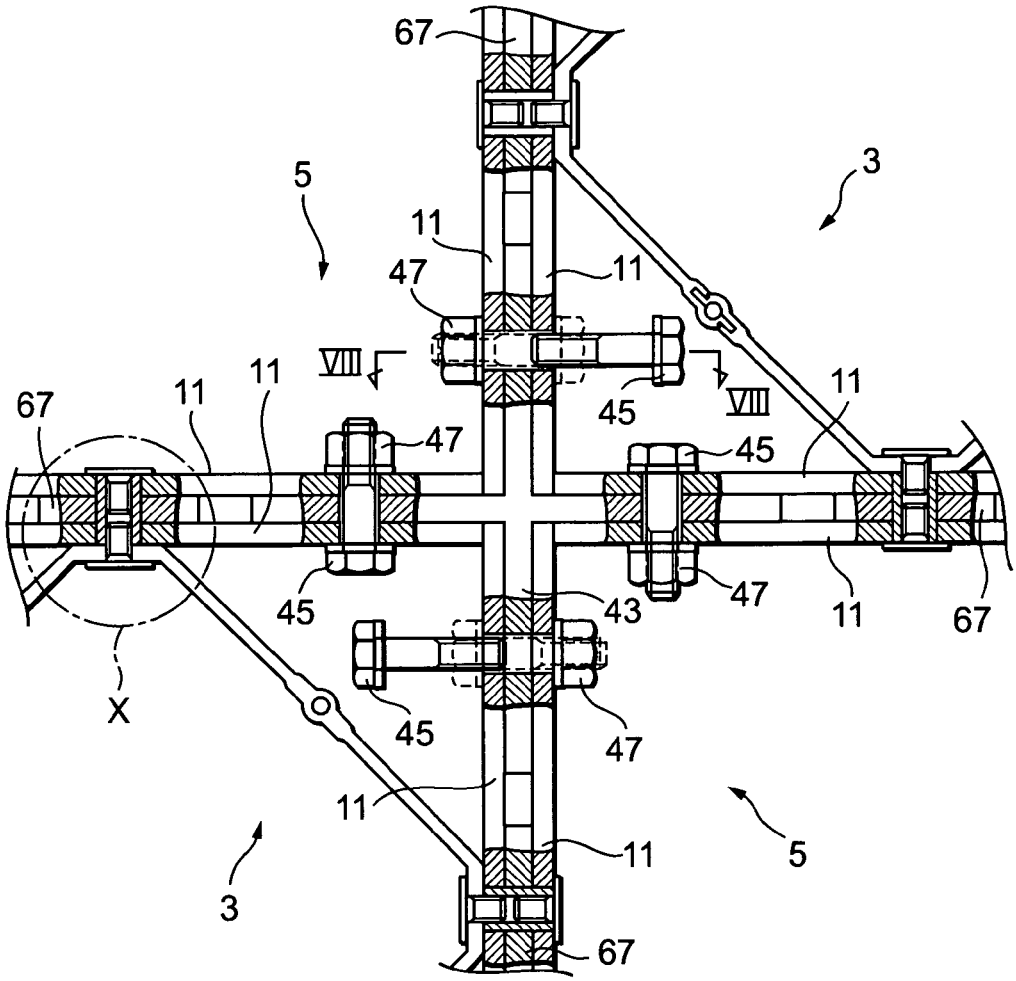
FIG. 5 is an expanded front view of part V of FIG. 1 according to the first embodiment of the present invention.
Figure 6:
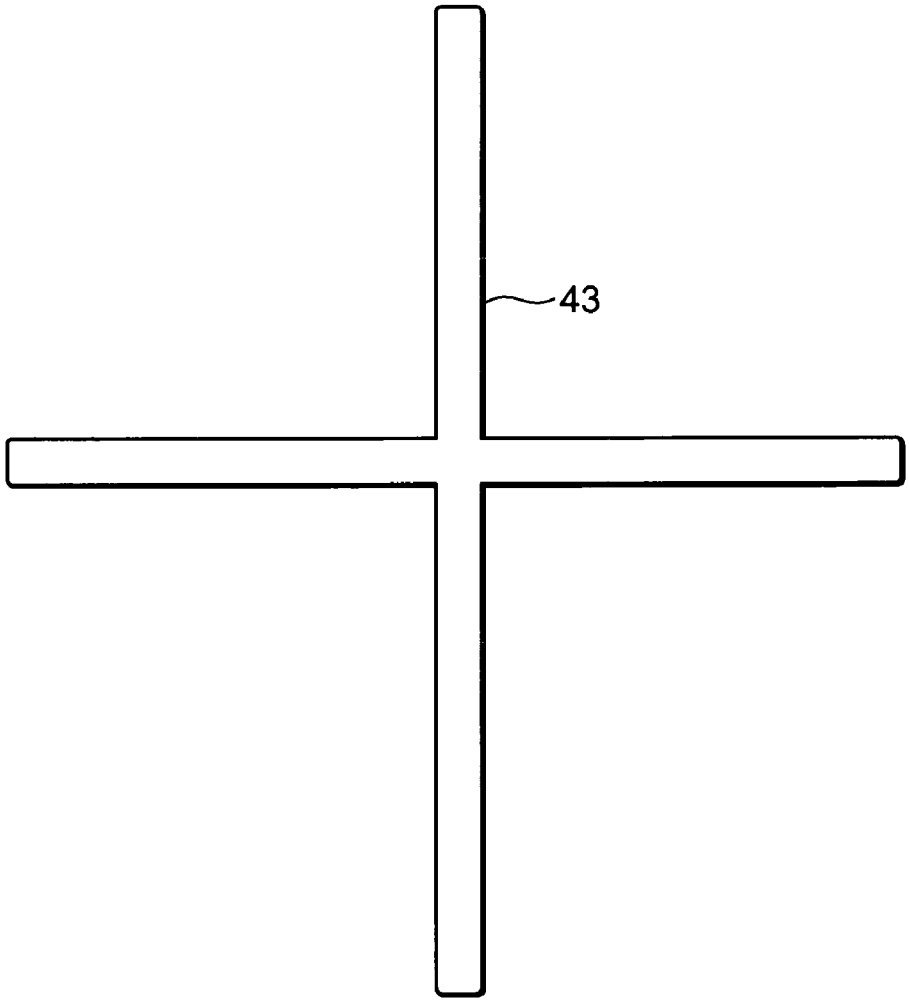
FIG. 6 is a front view of a spacer according to the first embodiment of the present invention.

Now an explanation will be made in regard to the part V shown in FIG. 1. FIG. 5 is an expanded view of the part V discussed above. There is a cross-shaped first spacer 43, inserted and placed between the frame members 11, 11 of the first panel 3 and the second panel 5 adjacent to each other, and bound and fixed by a plural number of connectors comprising bolts 45 and nuts 47. The first spacer 43 is illustrated in FIG. 6.

Figure 8:
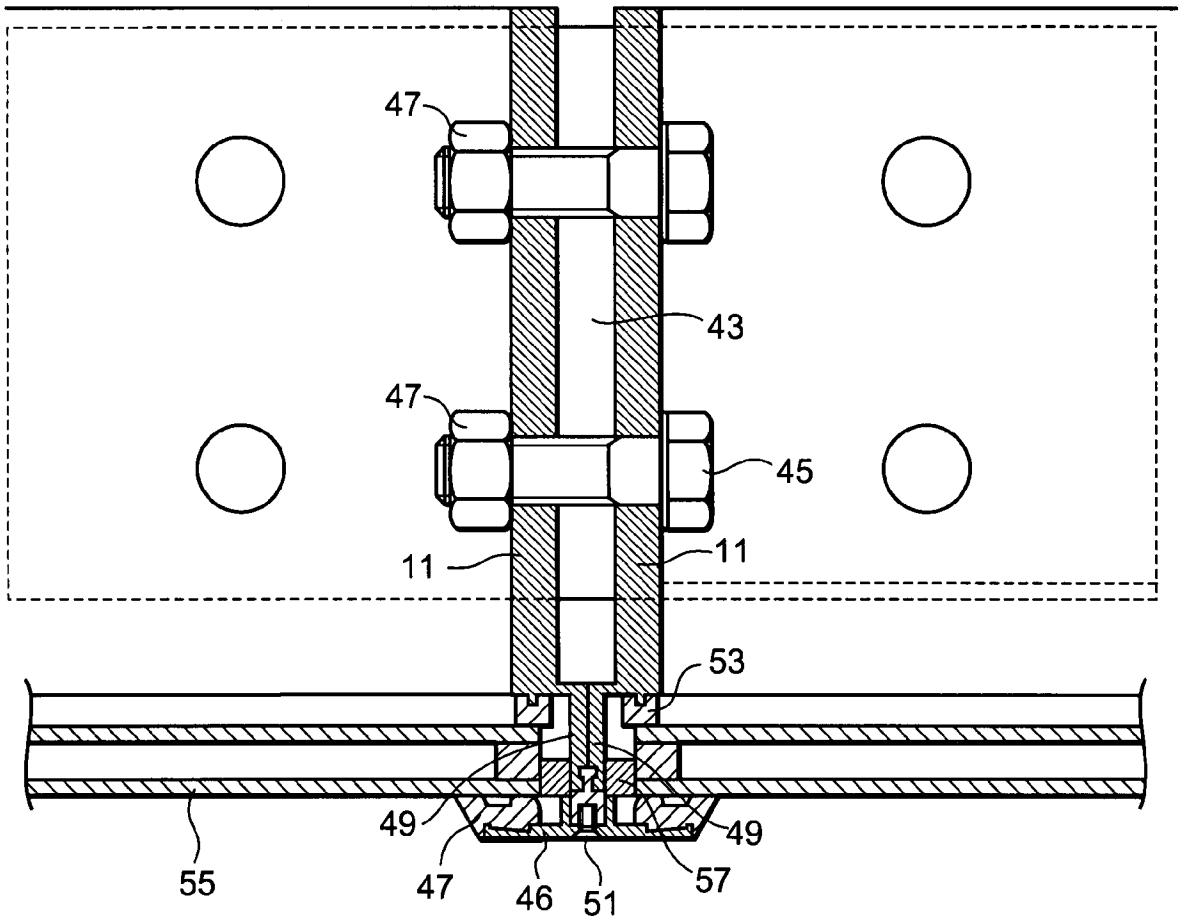
FIG. 8 is a sectional view as seen by the line VIII-VIII of FIG. 5 according to the first embodiment of the present invention.

Now an explanation will be made in regard to the sectional part VIII-VIII of FIG. 5. There are two connecting parts, by the connectors comprising bolts 45 and nuts 47 as discussed above, in the direction of thickness. As illustrated in FIG. 8, there are contact parts 49, 49 at the respective ends of the frame members 11, 11, and a surface frame member 46 is attached, via a gasket 47, to the position at which the contact parts 49, 49 become in contact with each other. The surface frame member 46 is fixed by a screw 51. Further, a pair glass 55 is held and fixed at a space between the gasket 47 and another gasket 53.

It should be noted that, reference numeral 57 shows a seal.

Figure 9:
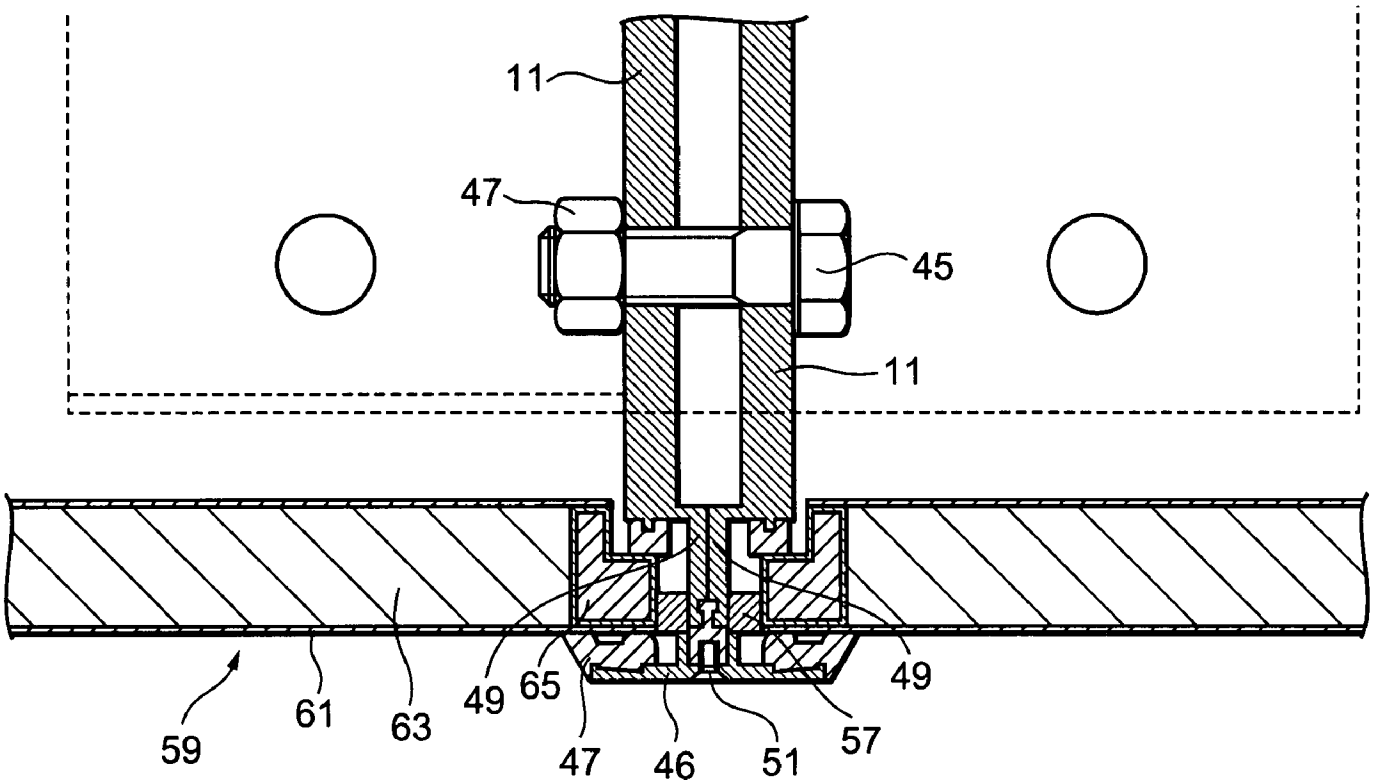
FIG. 9 is a sectional view of the lattice panel according to the first embodiment of the present invention.

As illustrated in FIG. 9, it is possible to attach, for example, aluminum honeycomb panel 59 instead of the pair glass 55. The aluminum honeycomb panel 59 comprises, a frame body 61 comprising an aluminum panel, and a honeycomb member 63, in which phenol resin has been filled, incorporated in the frame body 61. Reference numeral 65 shows a resin edge.

As discussed above, with reference to FIG. 1, the illustration of the pair glass 55 or the aluminum honeycomb panel 59 has not been made.

Figure 7:
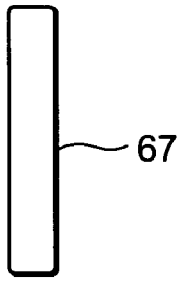
FIG. 7 is a front view of a spacer according to the first embodiment of the present invention.
Figure 10:
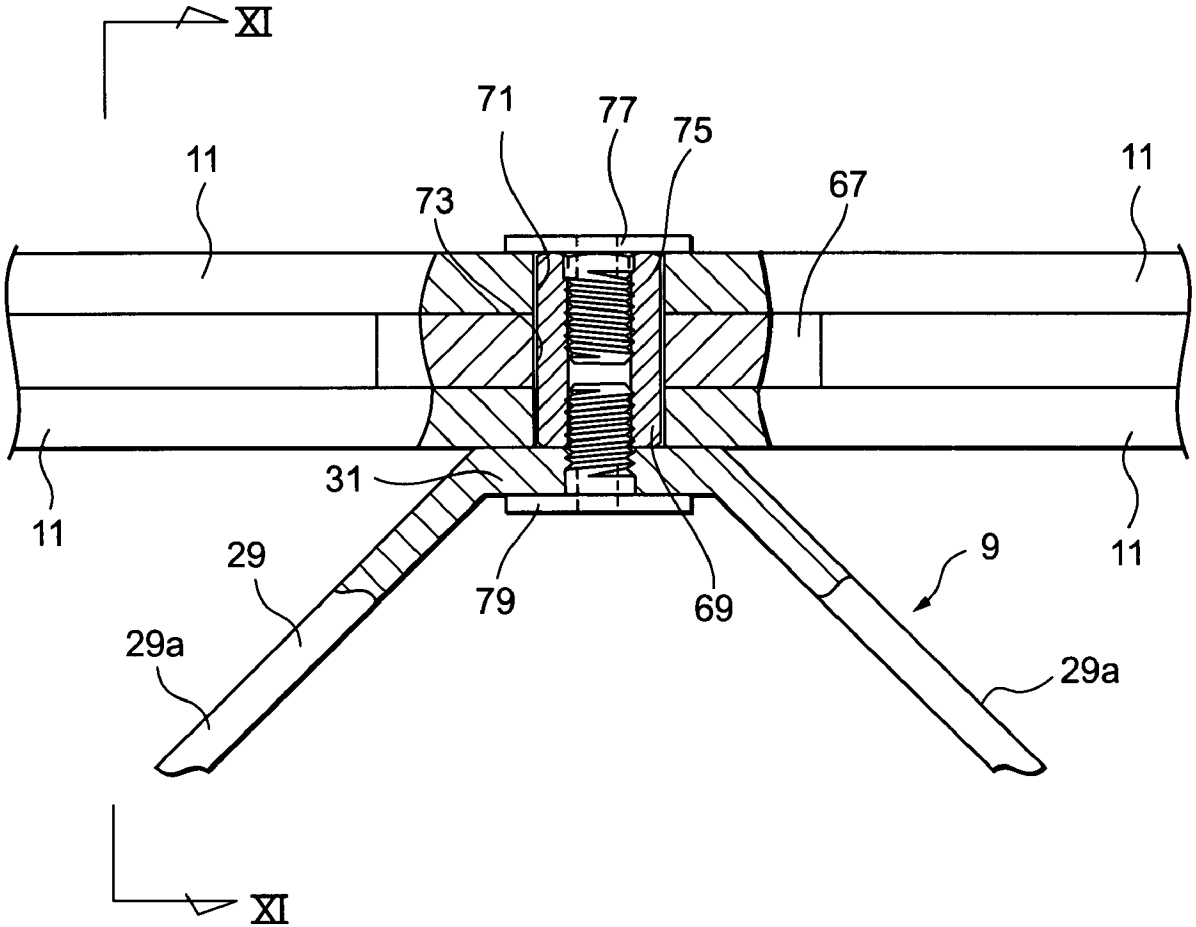
FIG. 10 is an expanded view of part X of FIG. 5 according to the first embodiment of the present invention.

Now referring back to FIG. 5, there is a second spacer 67, inserted in a position, at which the first panel 3 and the second panel 5 become in contact with each other, and at which the flat part 31 of the second skeleton member 9 is positioned. The second spacer 67 is illustrated in FIG. 7. The connecting structure of the position at which the second spacer 67 is provided, is illustrated in FIGS. 10 and 11.

There are penetrating holes 69, 71, 73, respectively formed in the frame members 11, 11 and the second spacer 67 positioned between them, and into which a hexagon nut 75 is inserted. There are fixing bolts 77, 79 engaged with the hexagon nut 75, whereby the first panel 3 and the second panel 5 are connected to each other.

Figure 11:
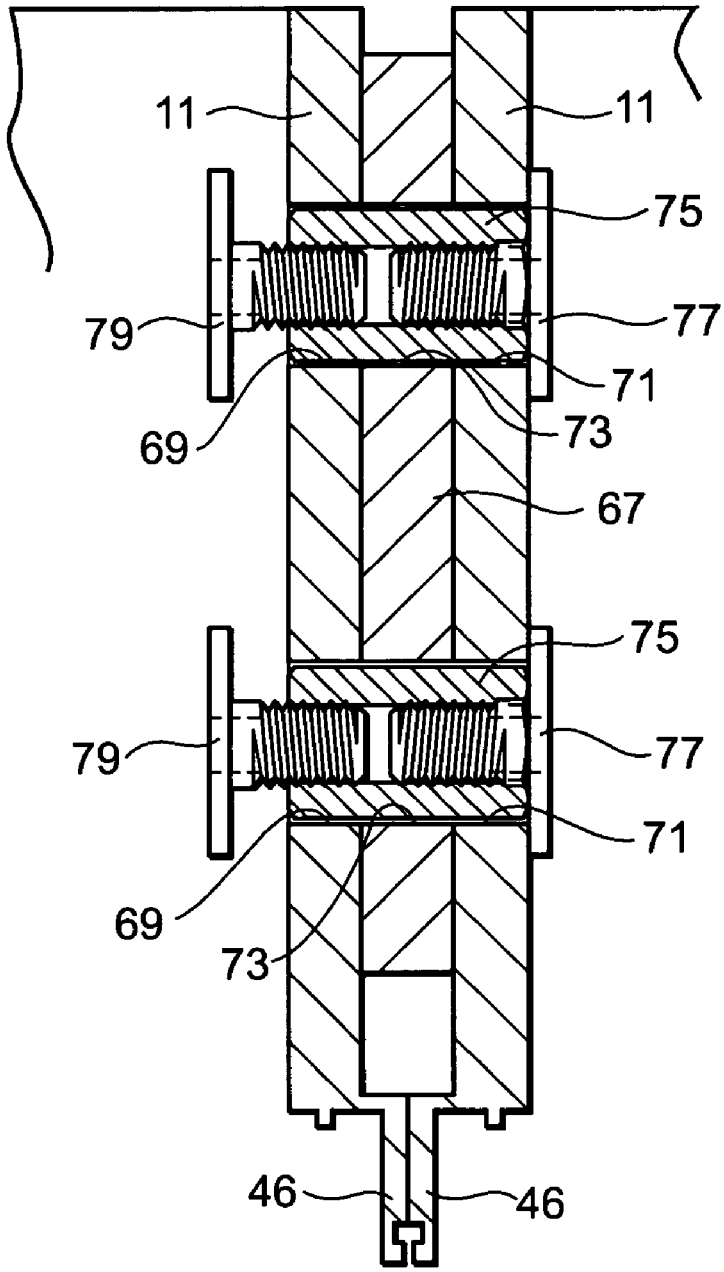
FIG. 11 is a sectional view as seen by the line XI-XI of FIG. 10 according to the first embodiment of the present invention.

As illustrated in FIG. 11, there are two fixing parts, fixed by the hexagon nut 75 and the fixing bolts 77, 79.

Figure 12:
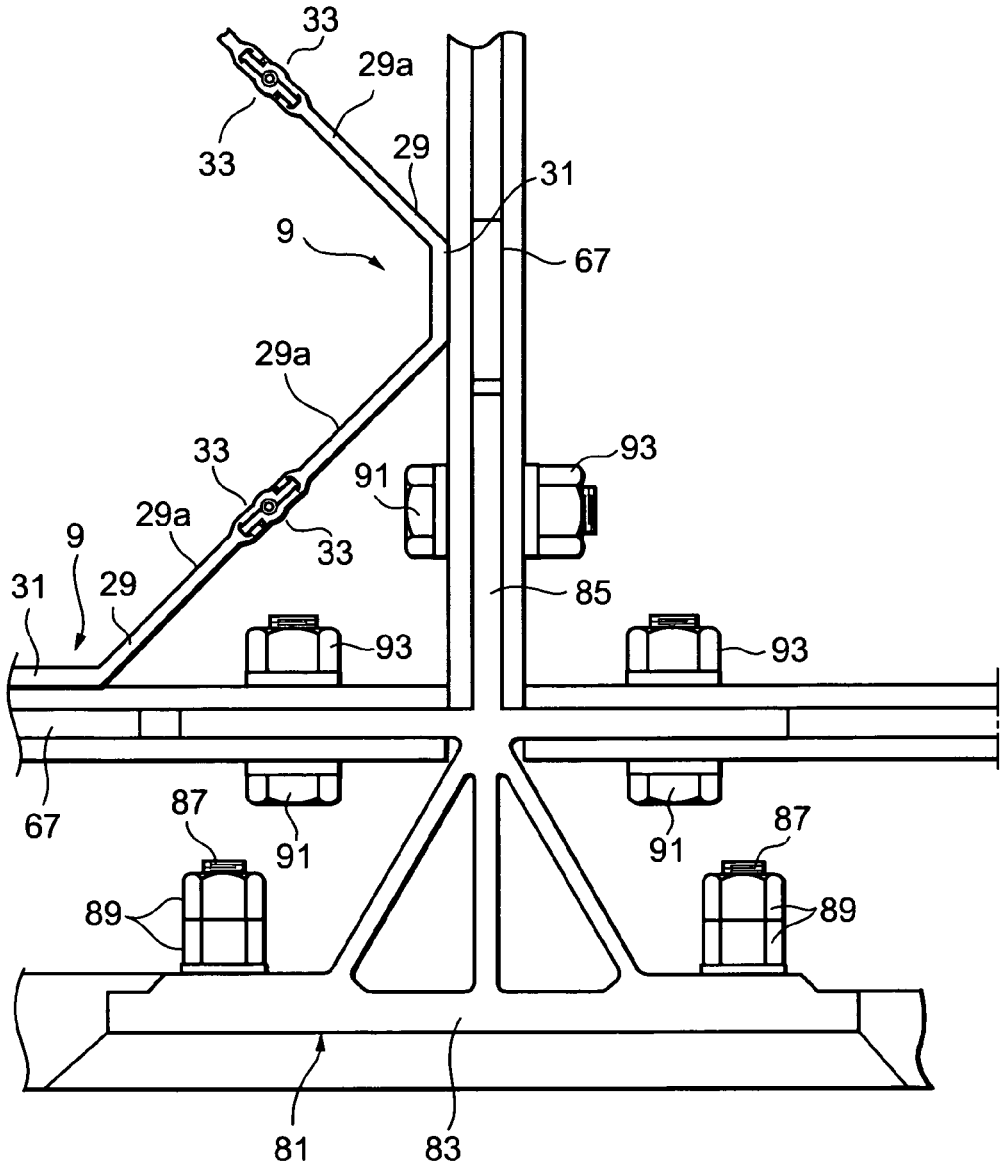
FIG. 12 is an expanded view of part XII of FIG. 1 according to the first embodiment of the present invention.

Now the structure of the part XII of FIG. 1 will be explained with reference to FIG. 12. There is a base member 81, comprising a base part 83 and a spacer part 85. The base part 83 is grounded, for example on grounding surface G, and fixed by a fixer comprising an anchor bolt 87 and a nut 89.

The spacer part 85 is substantially in a shape of the letter T, and an elongating part 85*a* is inserted in a space between the frame members 11, 11 of the first panel 3 and the second panel 5, and is bound and fixed by connectors comprising bolts 91 and nuts 93.

Thus, a wall structure of building may be made, by using the lattice panel 1 having the above structure. At that time, as discussed above, the pair glass 55 or the aluminum honeycomb panel 59 may be attached to the first panel 3 and the second panel 5.

The present embodiment has the following merits.

First, according to the present embodiment, there are several numbers of the cross-shaped first skeleton members 7 and the L-shaped second skeleton members 9, so that the first skeleton members 7 may be connected to each other, and also the second skeleton members 9 may be connected to the outer periphery of the first skeleton members 7, whereby the panel body is assembled, and the frame members 11 are attached to the outer periphery of the panel body, thus the lattice panel is made. Therefore, it is possible to provide a wall structure, having a relatively simple structure, and also a sufficient strength.

Second, the first skeleton member 7 has the engagement parts 19 at the end of four elongating parts 13*a*, so that the first skeleton members 7, 7 adjacent to each other may be connected by engaging the engagement parts 19, 19 with each other. Thus, it is possible to connect the first skeleton members 7, 7 to each other easily, and to obtain the reliable connecting structure.

Third, when the first skeleton members 19, 19 are connected to each other, the first recessed part 21 on the one side is engaged with the second salient part 27 on the other side, and the third recessed part 24 on the one side is engaged with the third salient part 28 on the other side, and vice versa. Thus, it is possible to obtain the strong connecting structure. This also applies to the relation of the engagement parts 19 and 33.

Fourth, with reference to the engagement structure of the first recessed part 21 with the second salient part 27, the hooks 21 and 27 are engaged with each other, so that the detachment in the elongating direction may be prevented. This also applies to the relation of the engagement parts 19 and 33.

Fifth, the second skeleton member 9 also has the engagement parts 33 at the end of two elongating parts 29*a*, respectively in the same shape as that of the engagement part 19 of the first skeleton member 7, so that the second skeleton member 9 may be connected to the adjacent first skeleton member 7, by engaging the engagement part 33 with the engagement part 19. Thus, it is possible to connect the first skeleton member 7 to the second skeleton member 9 easily, and to obtain the reliable connecting structure.

Sixth, the hollow circle is formed when the engagement parts 19, 19 or 19, 33 are connected to each other, and the engagement parts are fixed by inserting and adhering the axial member 30 into the hollow circle. Thus, it is possible to obtain further strong connecting structure.

Seventh, the flat part 31 is formed at the L-shape corner of the second skeleton member 9, and the second skeleton member 9 is fixed on the frame member 11 via the flat part 31. Thus, it is possible to obtain the stable fixing state on the frame members 11.

Eighth, the first panels 7, and the second panels 9 formed only by the frame members 11, are connected by houndstooth check arrangement. Thus, as compared with the case in which only the first panels 7 are used for the lattice panel, it is possible to reduce the total weight, and to facilitate the assemble working.

Second Embodiment

Figure 13:
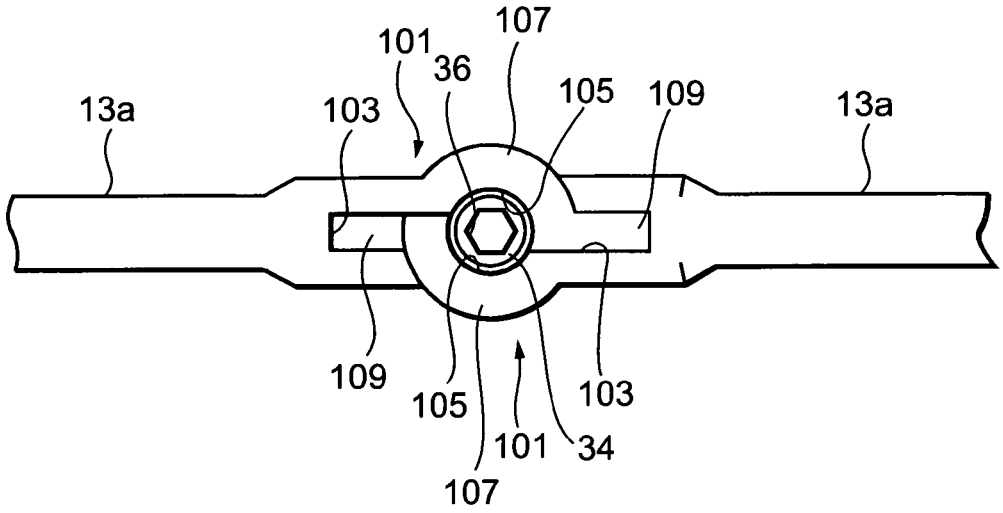
FIG. 13 is a view showing a connecting structure according to a second embodiment of the present invention, between a first skeleton member and another first skeleton member, or between the first skeleton member and a second skeleton member.

A second embodiment of the present invention will now be described with reference to FIG. 13. According to the second embodiment, the structure of the engagement parts of the first skeleton member 7 and the second skeleton member 9, has been changed. FIG. 13 illustrates a structure in which the first skeleton members 7, 7 are connected to each other. There are engagement parts 101, 101. Each of the engagement parts 101 has a first recessed part 103 elongated in the axial direction, a second recessed part 105 substantially in a half-round shape continuously formed by following the first recessed part 103, a first salient part 107 at the outer part of the second recessed part 105, and a second salient part 109 protruding at the and of the engagement part 101. The inside of the first recessed part 103 may be engaged, with the second salient part 109 of the engagement part 101 of the adjacent other first skeleton member 7.

The form of the engagement parts 101 of the first skeleton member 7, provided at the respective ends of the four elongating parts 13*a*, is in the same shape. Similarly, the form of the engagement parts 101 of the second skeleton members 9 is also in the same shape.

The both second recessed parts 105, 105 form a hollow circle, with which the screw member 34 is engaged.

According to the second embodiment as discussed above, it is possible to obtain substantially the same effect as that of the first embodiment.

Third Embodiment

Figure 14:
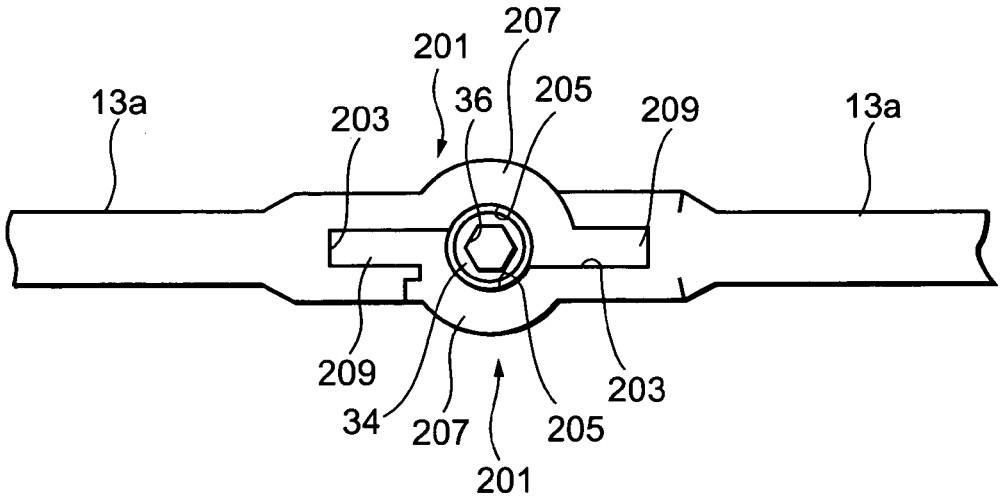
FIG. 14 is a view showing a connecting structure according to a third embodiment of the present invention, between a first skeleton member and another first skeleton member, or between the first skeleton member and a second skeleton member.

A third embodiment of the present invention will now be described with reference to FIG. 14. According to the third embodiment, the structure of the engagement parts of the first skeleton member 7 and the second skeleton member 9, has also been changed. FIG. 14 illustrates a structure in which the first skeleton members 7, 7 are connected to each other. There are engagement parts 201, 201. Each of the engagement parts 201 has a first recessed part 203 elongated in the axial direction, a second recessed part 205 substantially in a half-round shape continuously formed by following the first recessed part 203, a first salient part 207 at the outer part of the second recessed part 205, and a second salient part 209 protruding at the and of the engagement part 201. The inside of the first recessed part 203 may be engaged, with the second salient part 209 of the engagement part 201 of the adjacent other first skeleton member 7.

The form of the engagement parts 201 of the first skeleton member 7, provided at the respective ends of the four elongating parts 13*a*, is in the same shape. Similarly, the form of the engagement parts 201 of the second skeleton members 9 is also in the same shape.

The both second recessed parts 205, 205 form a hollow circle, with which the screw member 34 is engaged.

According to the third embodiment as discussed above, it is also possible to obtain substantially the same effect as those of the first and second embodiments.

Fourth Embodiment

Figure 15B:
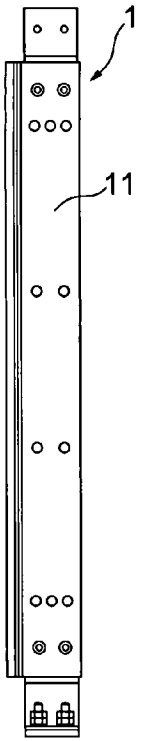
FIG. 15 has views showing a fourth embodiment of the present invention, in which, FIG. 15(*a*) is a partial front view of a lattice panel, and FIG. 15(*b*) is a side view of the lattice panel.
Figure 15A:
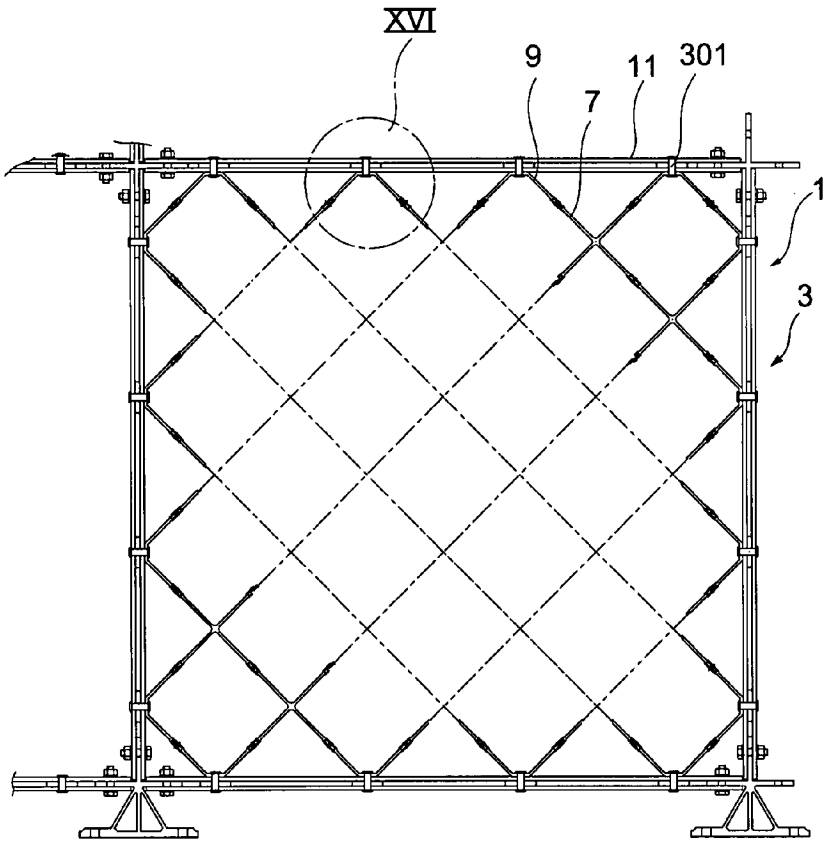
Figure 16:
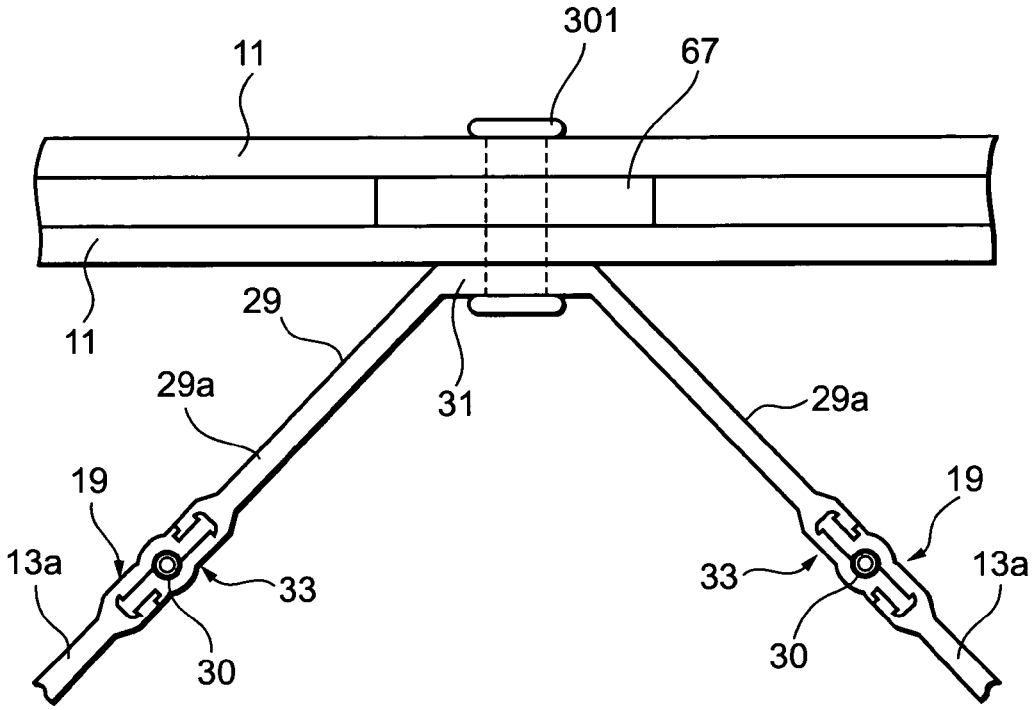
FIG. 16 is an expanded view of part XVI of FIG. 15 according to the fourth embodiment of the present invention.

A fourth embodiment of the present invention will now be described with reference to FIGS. 15 and 16. According to the first through third embodiments, the second skeleton members 9 are fixed on the frame members 11, by the hexagon nut 75 and the fixing bolts 77, 79 (see FIG. 10). However, according to the fourth embodiment, the fixing is done by rivets 301. The other structure is substantially the same as that of the first embodiment, so the identical reference numerals are given to the identical parts, and the detailed explanation will not be done here.

According to the fourth embodiment as discussed above, it is also possible to obtain substantially the same effect as those of the first through third embodiments.

The present invention is not limited to the first through fourth embodiments as discussed above, and any modification may be done without departing the spirit of the present invention.

For example, according to the first through fourth embodiments, the lattice panel comprises the first panels and the second panels. However, it is also possible to provide the lattice panel, which comprises only the first panels.

Further, it is possible to determine arbitrarily, what kind of panel member should be attached to the inner part of the each panel frame.

Further, the attached drawings merely give examples of the present invention.

What is claimed is:

1. A lattice panel comprising:

a panel body, assembled by continuously connecting a plurality of cross-shaped first skeleton members, and by continuously connecting L-shaped second skeleton members to an outer periphery of said first skeleton members; and frame members attached to an outer periphery of said panel body, wherein said first skeleton member includes engagement parts at an end of four elongating parts, such that said first skeleton members adjacent to each other may be connected by engaging said engagement parts with each other, wherein said second skeleton member includes engagement parts at an end of two elongating parts, respectively, in a same shape as that of said engagement part of said first skeleton member, such that said second skeleton member may be connected to said adjacent first skeleton member, by engaging said engagement part of said second skeleton member with said engagement part of said first skeleton member, wherein each of said engagement parts comprises:

a first recessed part;

a half-round shape of a second recessed part continuously formed by following said first recessed part;

a first salient part provided at the outer side of said second recessed part; and a second salient part protruding at the end of said engagement part, and wherein a hollow circle is formed by said second recessed parts when said engagement parts are connected to each other, and said engagement parts are fixed by inserting and adhering an axial member into said hollow circle, or said engagement parts are bound and fixed by engagement with a screw member inserted into said hollow circle.

2. The lattice panel as claimed in claim 1, wherein said first recessed part is engaged with said second salient part of another first skeleton member to be connected to each other, respectively having hooks at said first recessed part and said second salient part in order to prevent detachment thereof in the elongating direction.

3. The lattice panel as claimed in claim 1, wherein a flat part is formed at an L-shape corner of said second skeleton member, and said second skeleton member is fixed on said frame member via said flat part.

4. A lattice panel, comprising:

first panels according to claim 1; and second panels formed only by said frame members, wherein a plurality of said first panels and said second panels are connected to each other.

5. A lattice panel constructing method, comprising:

continuously connecting a plurality of cross-shaped first skeleton members, by engaging engagement parts with each other and by fixing through fixing means;

continuously connecting L-shaped second skeleton members to an outer periphery of said first skeleton members, by engaging engagement parts with each other and by fixing through fixing means, thus assembling a panel body;

constructing first panels by attaching frame members to the outer periphery of said panel body; and continuously connecting a plurality of said first panels, wherein said first skeleton member includes engagement parts at an end of four elongating parts, such that said first skeleton members adjacent to each other may be connected by engaging said engagement parts with each other, wherein said second skeleton member includes engagement parts at an end of two elongating parts, respectively in a same shape as that of said engagement part of said first skeleton member, such that said second skeleton member may be connected to said adjacent first skeleton member, by engaging said engagement part of said second skeleton member with said engagement part of said first skeleton member, wherein each of said engagement parts comprises:

a first recessed part;

a half-round shape of a second recessed part continuously formed by following said first recessed part;

a first salient part provided at the outer side of said second recessed part; and a second salient part protruding at the end of said engagement part, and wherein a hollow circle is formed by said second recessed parts when said engagement parts are connected to each other, and said engagement parts are fixed by inserting and adhering an axial member into said hollow circle, or said engagement parts are bound and fixed by engagement with a screw member inserted into said hollow circle.

6. The lattice panel constructing method as claimed in claim 5, further comprising:

preparing second panels formed only by said frame members; and continuously connecting a plurality of said second panels to said first panels.

7. The lattice panel according to claim 1, further comprising:

a spacer disposed between said frame members.

8. The lattice panel constructing method according to claim 6, further comprising:

forming a spacer disposed in a position at which said first panels and said second panels come into contact with each other.

9. A lattice panel comprising:

a panel body, comprising:

a plurality of connected cross-shaped first skeleton members;

a plurality of L-shaped second skeleton members connected to outer peripheries of said first skeleton members;

frame members attached to an outer periphery of said panel body; and engagement parts for connecting adjacent first skeleton members and said second skeleton members, wherein each of said engagement parts comprises:

a first recessed part;

a half-round shape of a second recessed part continuously formed by following said first recessed part;

a first salient part provided at the outer side of said second recessed part; and a second salient part protruding at the end of said engagement part, and wherein a hollow circle is formed by said second recessed parts when said engagement parts are connected to each other, and said engagement parts are fixed by inserting and adhering an axial member into said hollow circle, or said engagement parts are bound and fixed by engagement with a screw member inserted into said hollow circle.

* * * * *